US006315177B1

(12) United States Patent
Weatherall

(10) Patent No.: US 6,315,177 B1
(45) Date of Patent: Nov. 13, 2001

(54) CANOE CARRIER BACKPACK WITH COLLAPSIBLE TABLE

(76) Inventor: Dave Weatherall, 3088 Fieldgate Dr., Mississauga, Ontario (CA), L4X 2H3

( * ) Notice: Subject to any disclaimer, the term of this patent is extended or adjusted under 35 U.S.C. 154(b) by 0 days.

(21) Appl. No.: 09/469,796

(22) Filed: Dec. 22, 1999

Related U.S. Application Data

(60) Provisional application No. 60/113,946, filed on Dec. 24, 1998.

(51) Int. Cl.[7] ..... A45F 4/02

(52) U.S. Cl. ..... 224/153; 224/259; 224/261; 224/262; 224/633; 224/634

(58) Field of Search ..... 224/153, 633, 224/634, 635, 259, 260, 261, 262, 263

(56) References Cited

U.S. PATENT DOCUMENTS

| | | | | |
|---|---|---|---|---|
| 3,648,907 | * | 3/1972 | Romney | 224/633 |
| 3,659,760 | | 5/1972 | Blood . | |
| 3,734,367 | * | 5/1973 | Jackson | 224/262 |
| 4,361,259 | * | 11/1982 | Chanter | 224/633 |
| 4,369,903 | | 1/1983 | Wilkes . | |
| 4,561,578 | | 12/1985 | Bell . | |
| 4,582,165 | * | 4/1986 | Latini | 224/153 X |
| 5,547,246 | | 8/1996 | Lambert . | |
| 5,762,251 | | 6/1998 | Gleason . | |
| 5,806,740 | | 9/1998 | Carlson . | |
| 5,875,946 | * | 3/1999 | Knudsen | 224/262 |
| 5,975,389 | * | 11/1999 | Braun et al. | 224/155 |

* cited by examiner

*Primary Examiner*—Gregory M. Vidovich
*Assistant Examiner*—Maerena N. Brevaro
(74) *Attorney, Agent, or Firm*—Eugene J. A. Gierczak

(57) ABSTRACT

A frame assembly for a canoe backpack carrier comprising of a support rods and cross braces, adjustable webbing and straps, which allows for an individual to carry a canoe of substantial weight over rough terrain.

17 Claims, 14 Drawing Sheets

CANOE CARRIER BACKPACK WITH COLLAPSIBLE TABLE

This application claims benefit of Provisional No. 60/113,946, filed Dec. 24, 1998.

FIELD OF INVENTION

This invention relates generally to a frame assembly for a backpack and more specifically to a frame assembly for a backpack that has been designed to easily carry a canoe and collapsible table.

BACKGROUND OF INVENTION

Numerous styles of backpacks have been developed to help the hiker or user to more comfortably carry a wide variety objects. The evolution of the backpack carrier has focused on providing greater comfort, convenience and support for the user. Specific difficulties arise when one is trying to carry any substantial weight during a long hike or traverse uneven terrain. Traditional backpack frames often provided just a frame and shoulder straps. This arrangement promoted tension and excessive muscle use from trying to effectively accommodate and negotiate a heavy load on the user's back.

Specific problems arise when the user is trying to carry a heavy and long canoe over any substantial distance or rough terrain. Since canoes are a substantial weight, it is difficult for one person to carry it and often requires two people. Even with two people, problems can arise depending on the terrain that is being traversed, and whether the physical abilities of the two individuals are matched. People portaging on their own are at a further disadvantage as they must try to manoeuvre the canoe on their own.

Prior art back-packs and carriers have been devised to address the aforenoted problems. For example, U.S. Pat. No. 5,547,246 issued on Aug. 20, 1996 to Michael Lambert of Ottawa, Canada, relates to a combination canoe carrier and camp chair. The carrier supports an inverted canoe on a person's back and is also capable of being converted to a folding camp chair. In the canoe carrier mode, a web interconnects upper ends of the frames to support the thwart of the inverted canoe. Suitable shoulder straps and a hip belt are also attached to the carrier.

Furthermore, due to the heavy loads and the lack of amenities that are available on such portage trips, the ability to have other camping equipment, such as a chair or table would be beneficial.

Donald F. Wilkes of Albuquerque, N.M., is the owner of U.S. Pat. No. 4,369,903 which issued on Jan. 25, 1983. This patent relates to a pack frame for a backpack which includes structure for transferring a substantial portion of the vertical load component to a position at the hip area of a wearer which is well below the load's centre of gravity. The pack frame is comprised of a tubular frame structure which is adapted to support a load on the back of a wearer.

U.S. Pat. No. 4,561,578 issued to Michael S. Bell of Goleta, Calif. on Dec. 31, 1985. This patent relates to a backpack with a frame to carry a load. The frame has a pair of upright rails, one at each side of the hiker. An encircling belt is attached to each of the upright rails, and a pair of shoulder rests fit over each of the shoulders.

U.S. Pat. No. 5,762,251 was issued on Jun. 9, 1998 has been assigned to Dana Design Ltd. of Bozeman, Mont. This patent relates to an external frame backpack which includes a frame, a hip-belt, two flexible stays, a back panel, and a lower panel. The frame is external and substantially rigid.

U.S. Pat. No. 3,659,760 issued on May 2, 1972 to the inventor Lewis H. Blood of Leonardo, N.J. This patent relates to shoulder carriers or slings and to a type that is adapted for the transport particularly of canoes, small boats or outboard motors. It involves shoulder straps in the form of loops, connected at both ends, and a board in which the straps are attached and adjustable and said board provided with means to hold a boat, canoe or outboard motor.

U.S. Pat. No. 3,734,367 issued to William S. Jackson of Ann Arbor, Mich. on May 22, 1973. This patent relates to an apparatus to be worn by an individual for carrying a canoe in an inverted position and simultaneously to be used for carrying a pack. The apparatus comprises a pack carrier adapted to be strapped to the back of the individual, and includes arms pivotally connected to the lower portion of the pack carrier and having attachment means at the distal ends of the arms for attachment to a transverse strut of the canoe.

Raytheon Company is the owner of U.S. Pat. No. 5,806,740 which issued on Sep. 15, 1998. This patent relates to an improved universal adjustable modular load backpack for carrying heavy loads to be used in conjunction with a multi-functional, soldier-centred, computer enhanced warfare system and includes storage modules releasably mounted on a flexible pack frame extending the wearer's level of comfort and range of motion.

Thus a frame assembly for a canoe backpack carrier which allows for an individual to carry a canoe on their own, is comfortable and reduces the tension an individual experiences while carrying the backpack and includes additional camping equipment such as a collapsible table is desirable.

SUMMARY OF THE INVENTION

An object of one aspect of the present invention is to provide an improved frame assembly for a canoe backpack carrier that can include a collapsible table and that can be operated by an individual.

In accordance with one aspect of the present invention, there is provided a frame assembly for a canoe backpack carrier comprising of a support means, an adjustable holding means and an adjustable carrying means. The adjustable carrying means may be attached to the support means to allow a user to carry the frame assembly. The support means may be adapted to receive the adjustable holding means which secures the canoe to the frame assembly and more particularly to the support means.

Conveniently, the support means may be further defined as a series of rods having cross braces. The rods and cross braces are arranged in such a fashion so as to provide two pairs of rods that are connected to one another at one end of the frame assembly.

Preferably the adjustable holding means may be further defined as an adjustable web that is secured to the cross braces of the support means. The adjustable web may allow for the canoe, and more specifically the cross strut located at the centre of the canoe, to rest on the frame assembly securely.

The adjustable carrying means may be further defined to include an adjustable back pad, adjustable straps, and hip belt that may be attached to the rods and cross braces. The supports means may include additional supports that may be defined as C-channels that can be used to attach to the frame assembly or other solid object to form a support for a table.

Advantages of the present frame assembly for carrying a canoe include: easy mounting and securing of the canoe to the frame assembly; the ability to mount and secure the canoe by one person, the user; improved distribution of the canoe's weight on the user's back and shoulders; adjustable webbing to allow the user to mount and carry a variety of types of canoes and a collapsible table concealed within the frame assembly.

BRIEF DESCRIPTION OF DRAWINGS

A detailed description of the preferred embodiments are provided herein below by way of example only with reference to the following drawings, in which.

Figure 1:
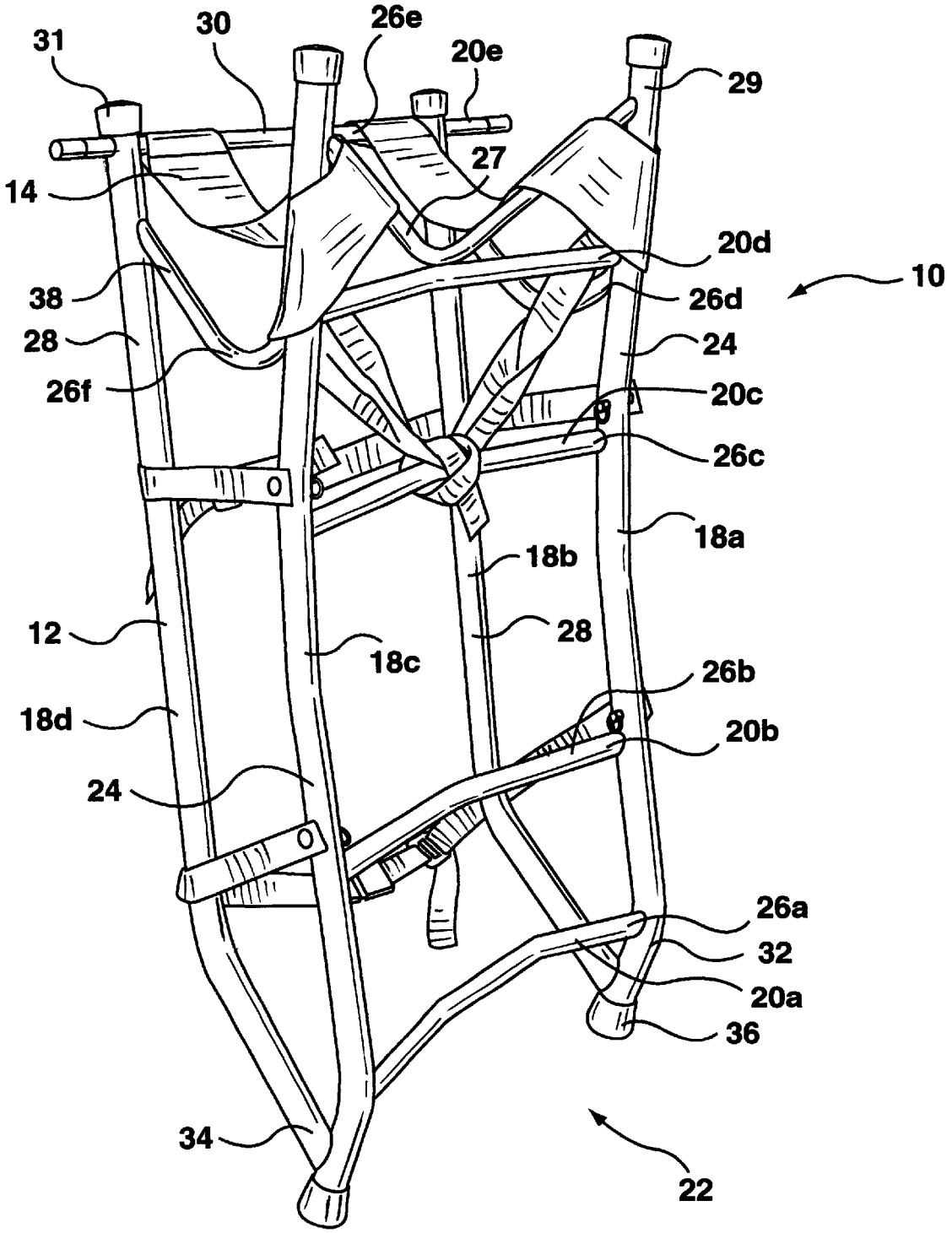
FIG. 1, in a front perspective view, illustrates a frame assembly in accordance with a preferred embodiment of the present invention.
Figure 2:
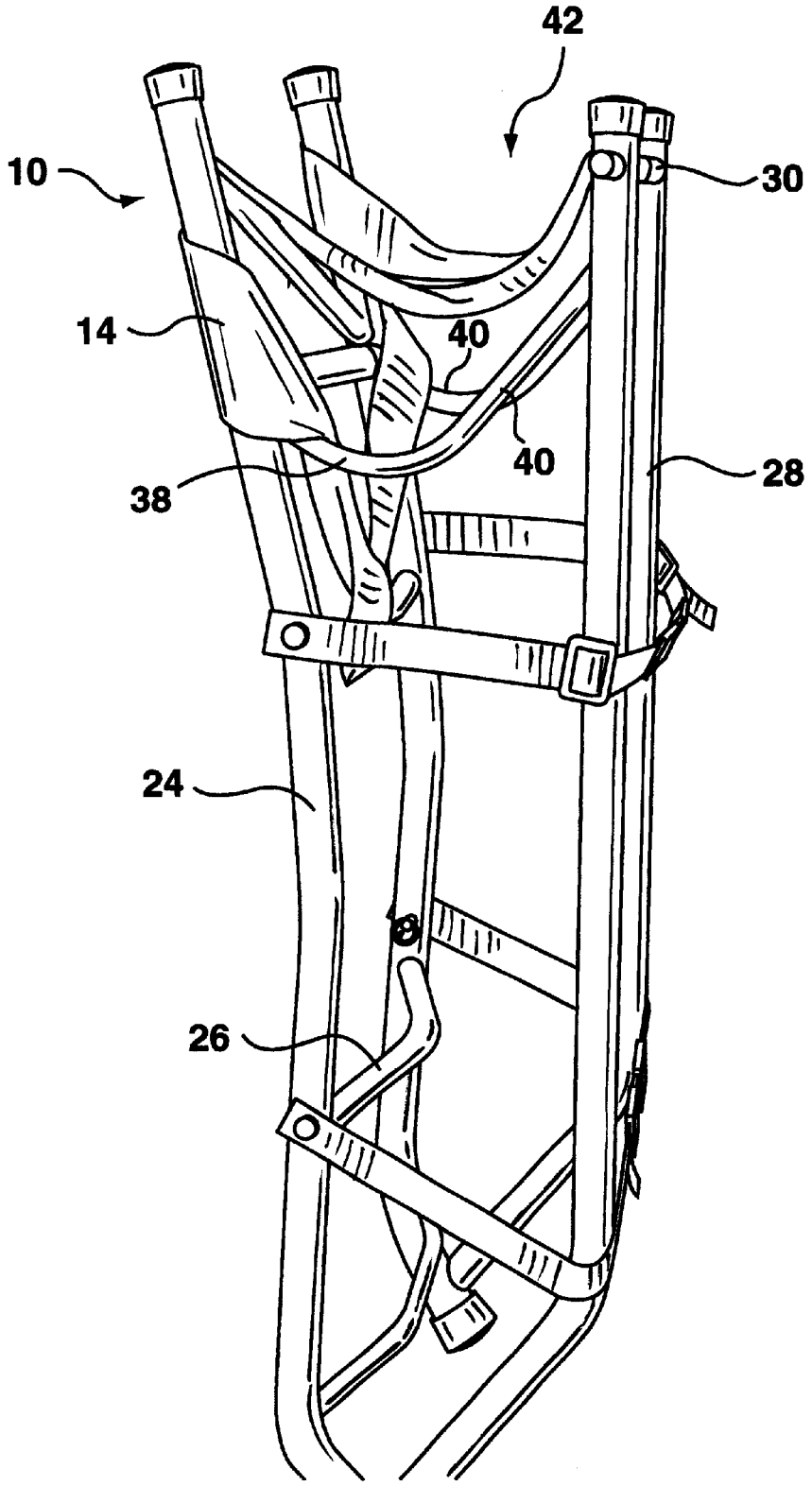
FIG. 2, in a side view, illustrates a frame assembly as described in FIG. 1.
Figure 3:
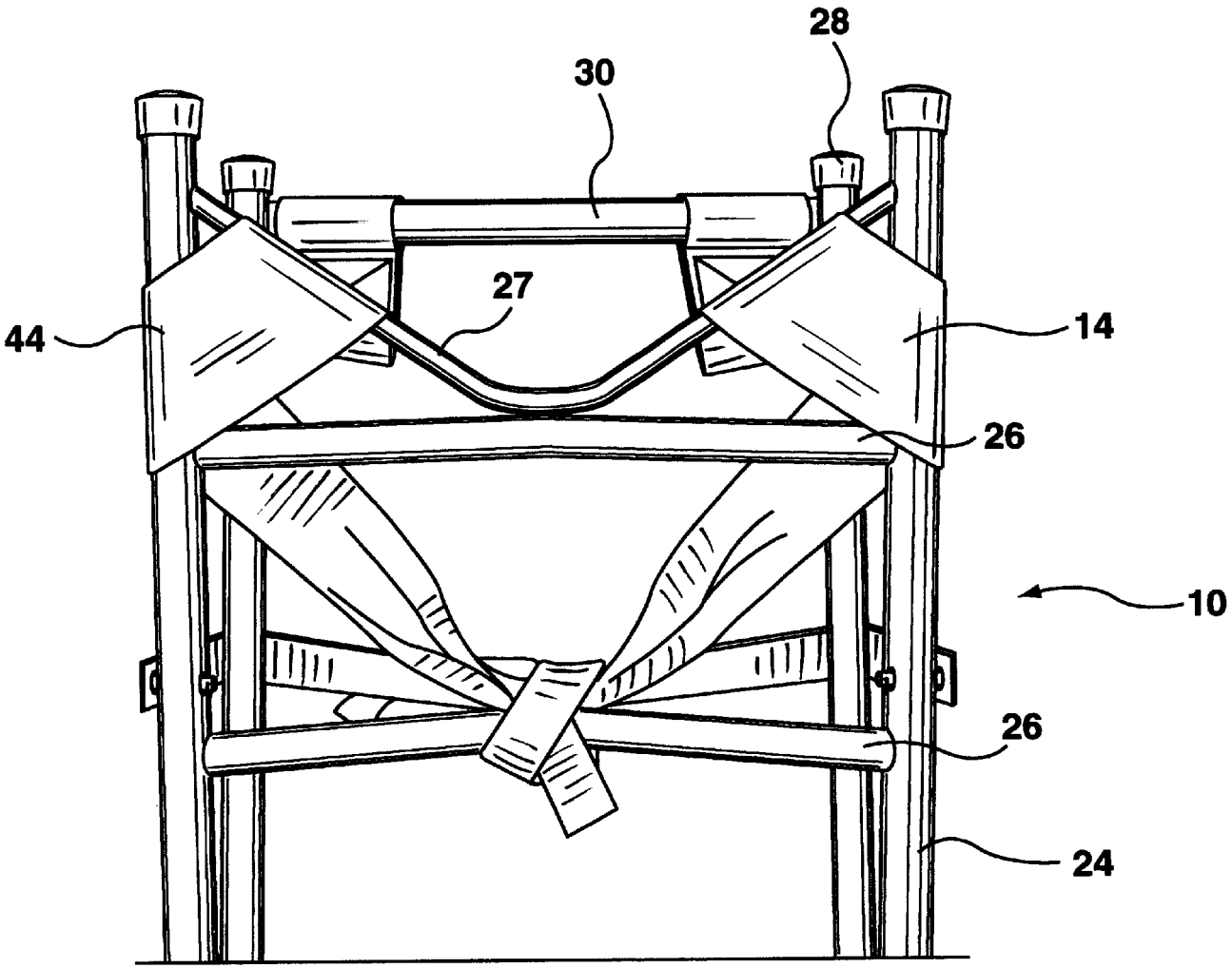
FIG. 3, in a front view, illustrates a frame assembly showing the adjustable holding means.
Figure 4:
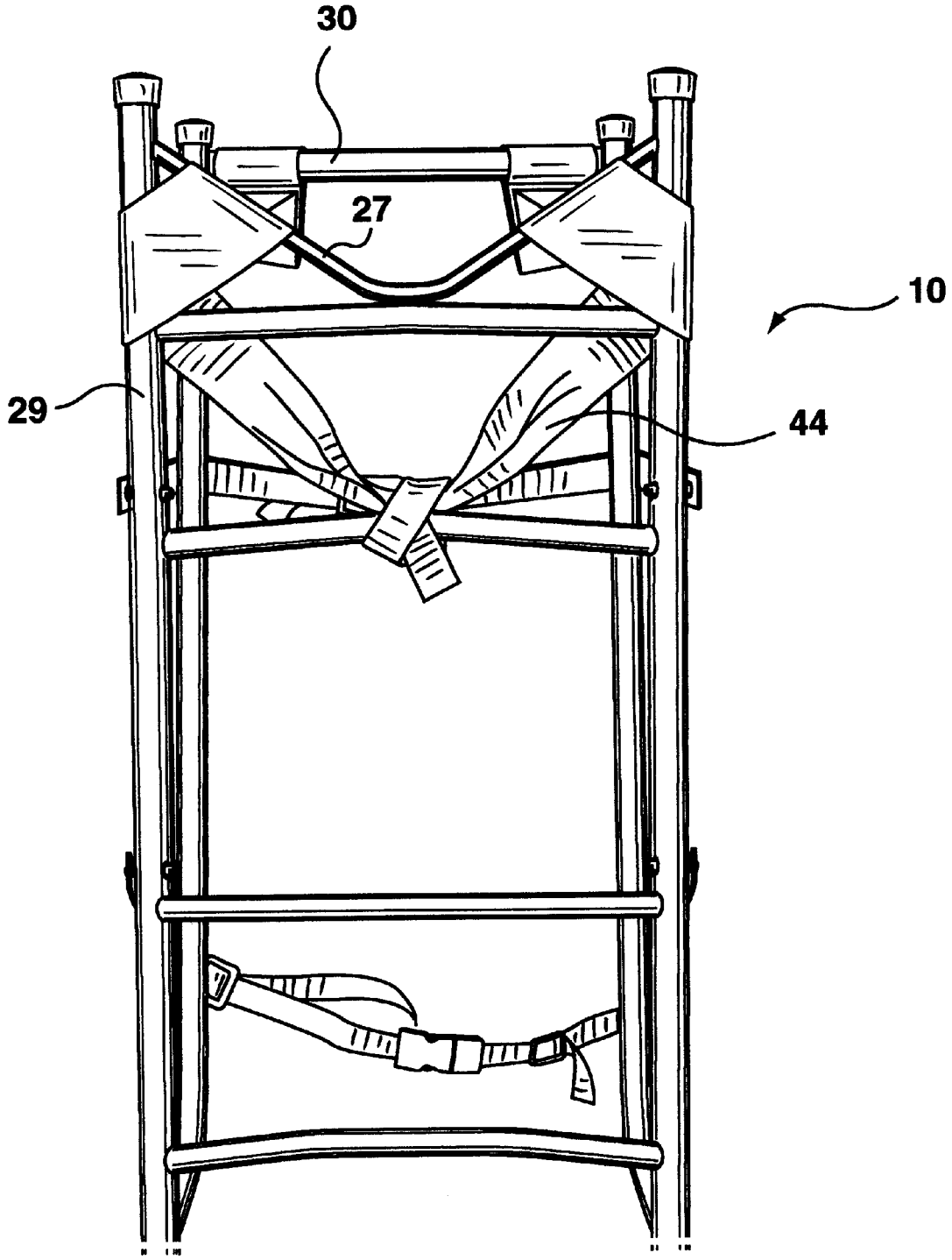
FIG. 4, in a front view, illustrates a frame assembly as described in FIG. 1.
Figure 5:
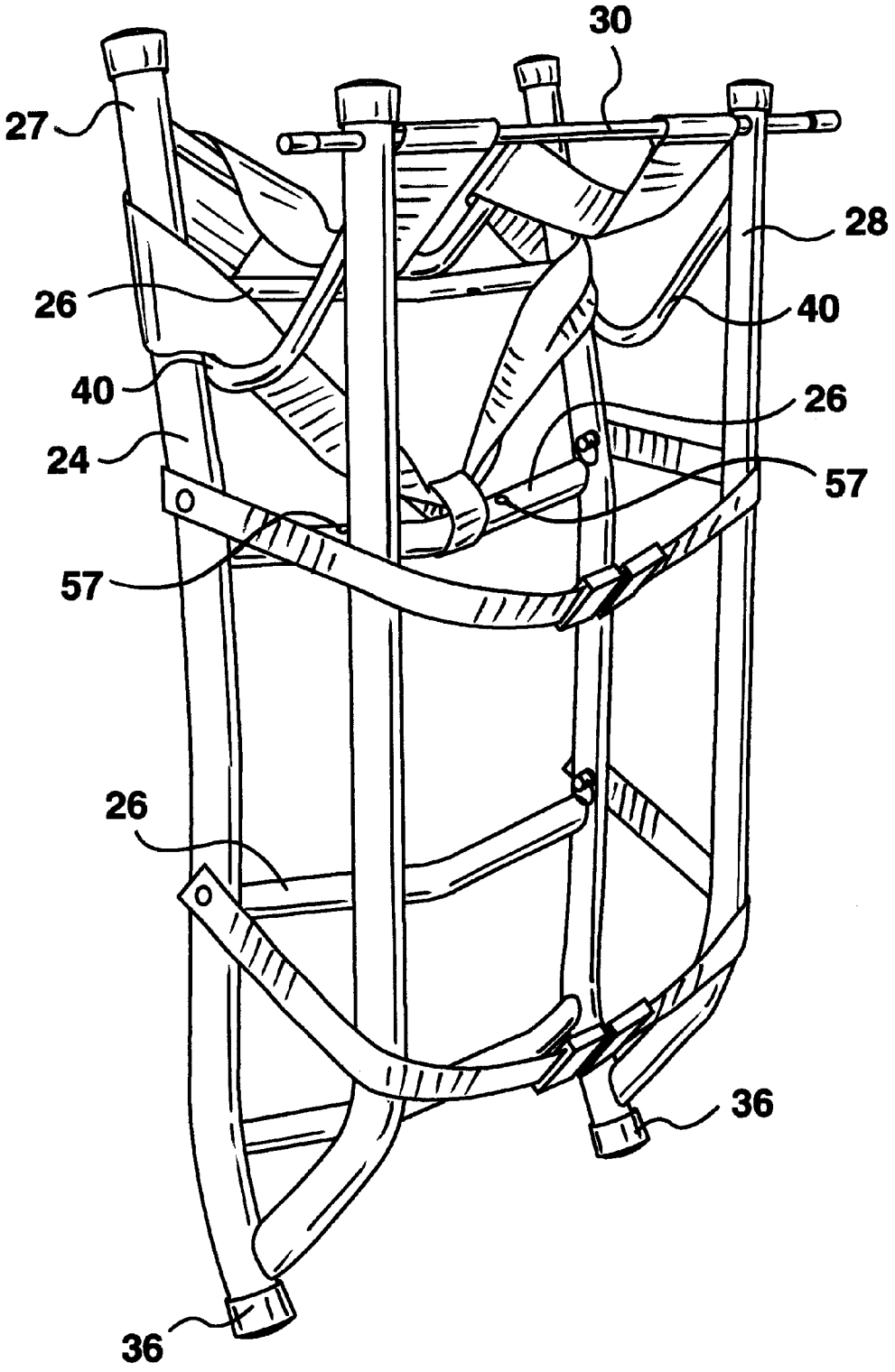
FIG. 5, in a back perspective view, illustrates a frame assembly including the carrying means in accordance with a preferred embodiment of the present invention.
Figure 6:
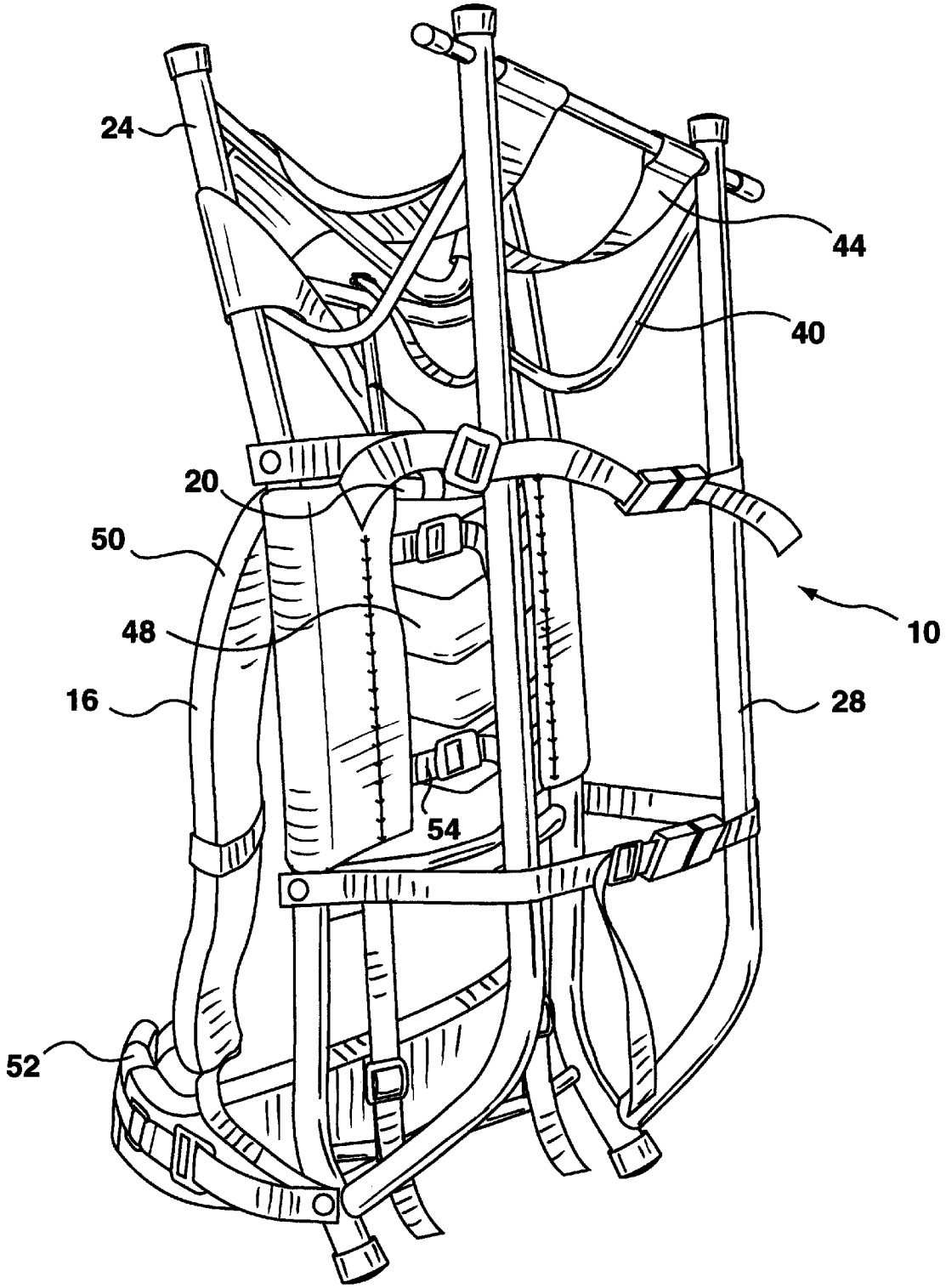
FIG. 6, in a perspective view, illustrates a frame assembly including the carrying means in accordance with a preferred embodiment of the present invention.
Figure 7:
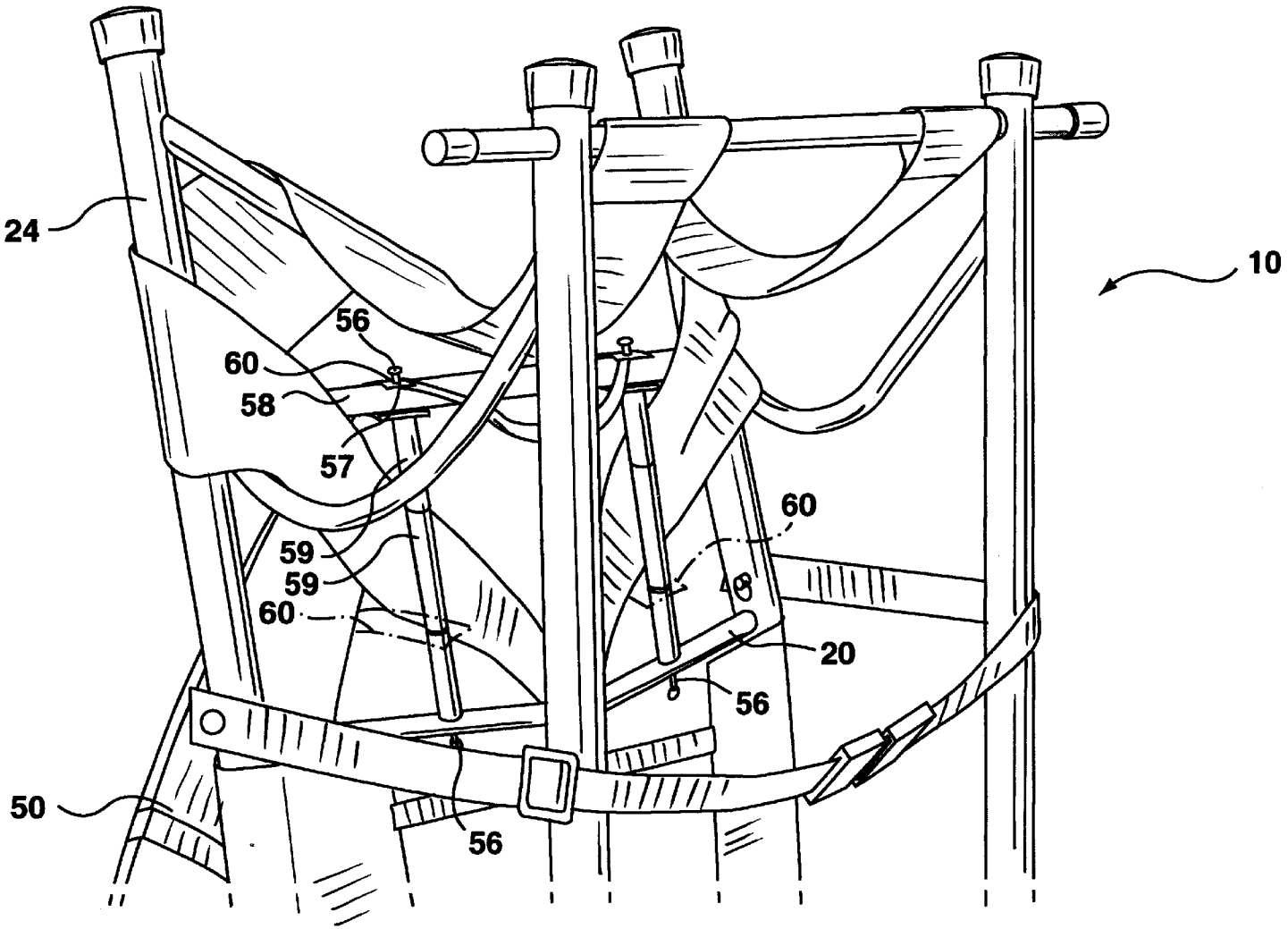
FIG. 7, in a close-up back perspective view, illustrates a frame assembly as described in FIG. 6.
Figure 8:
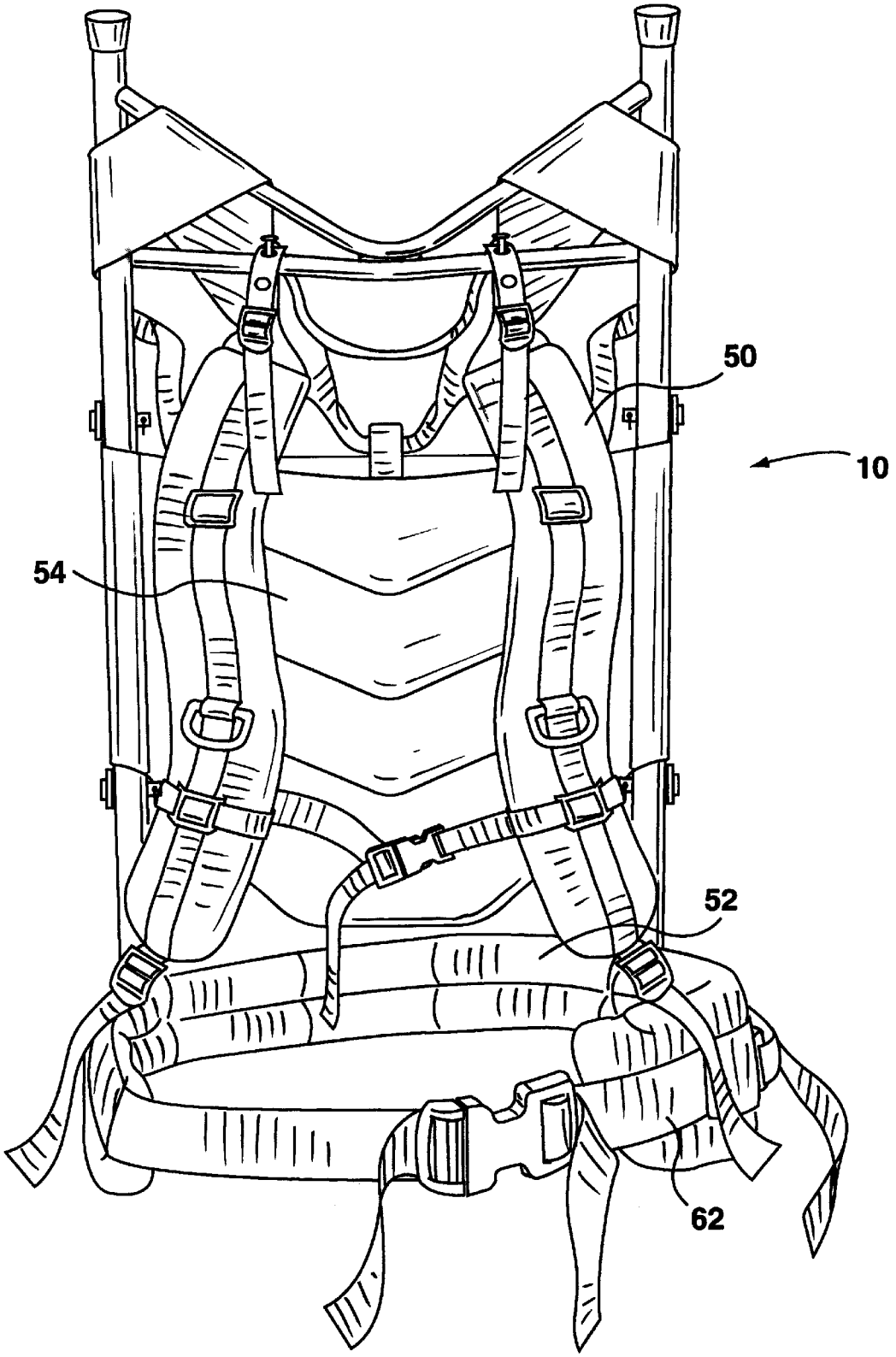
FIG. 8, in a front view, illustrates a frame assembly as described in FIG. 5.
Figure 9:
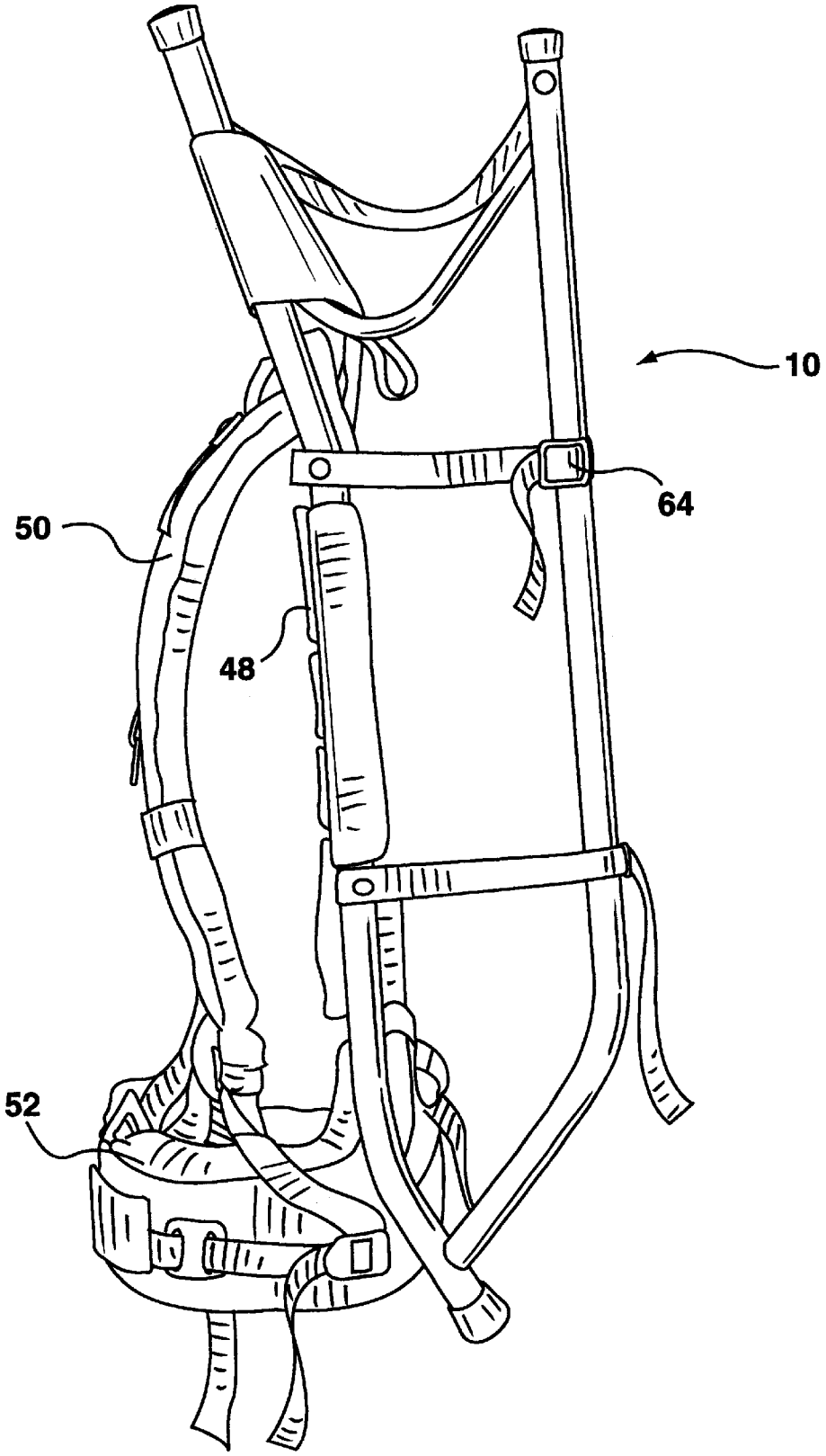
FIG. 9, in a side view, illustrates a frame assembly as described in FIG. 5.

In the drawings, preferred embodiments of the invention are illustrated by way of example. It is to be expressly understood that the description and the drawings are only for the purpose of illustration and as an aid to understanding, and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIGS. 1–6, there is illustrated a frame assembly for a canoe backpack carrier 10 in accordance with a preferred embodiment of the present invention. The frame assembly 10 includes a support means 12, an adjustable holding means 14 and an adjustable carrying means 16. The adjustable carrying means 16 shown in FIG. 6 requires a strap 15. The adjustable carrying means 16 may associate with the support means 12 to allow a user to carry the frame assembly 10 on his/her back. The support means 12 may associate with the adjustable holding means 14 which secures the canoe to the support means 12.

The support means 12 may be further defined as a series of rods 18*a–d* having cross braces 20*a–e*. The rods 18*a–d* and cross braces 20*a–e* may be arranged in such a fashion so as to provide two pairs of rods 24 and 28 that are connected to one another at the bottom end 22 of the frame assembly 10. More specifically, the first pair of rods 18*a* and 18*b* may be connected to the second pair of rods 18*c* and 18*d* by cross braces 26*a–f*.

The first pair of rods 24 and the cross braces 26*a–d* may be curved and arranged in such a way so that the adjustable carrying means 16 may attach to the first pair of rods 24 and the cross braces 26*a–d*. Therefore the first pair of rods 24 are oriented closest to the user's back. An additional cross brace or support brace 27 may be located at the top end 29 of the frame assembly 10. The support brace 27 may be attached to the first pair of rods 24.

The second pair of rods 28 may be connected to one another with a cross brace 30 to form the second pair of rods 28. The cross brace 30 may be located at the top end 31 of the second pair of rods 28. The second pair of rods 28 may be hollow to accommodate a length of C-channel 25 concealed within the second pair of rods 28. The ends 33 of both the first pair of rods 24 and the second pair of rods 28 may be covered with a protective caps 35 which also secures the length of C-channel 25 within the second pair of rods 28.

The bottom end 32 of the first pair of rods 24 and bottom end 34 of the second pair 28 are connected at the bottom end 22 of the frame assembly 10. More specifically, the connection of the first pair of rods 24 to the second pair of rods 28 may end in at least one foot 36 that allows for the frame assembly 10 to rest against the ground when the user is not wearing the frame assembly 10.

The first pair of rods 24 may also be connected to the second pair of rods 28 by an additional cross brace 38. The cross brace 38 may be further defined as a pair of curved cross braces 40 that connect the two pairs of rods 18 at the top end 42 of the frame assembly 10. The pair of curved cross braces 40 are oriented in such a way so as to help orient the adjustable holding means 14 on the frame assembly 10.

Figure 10:
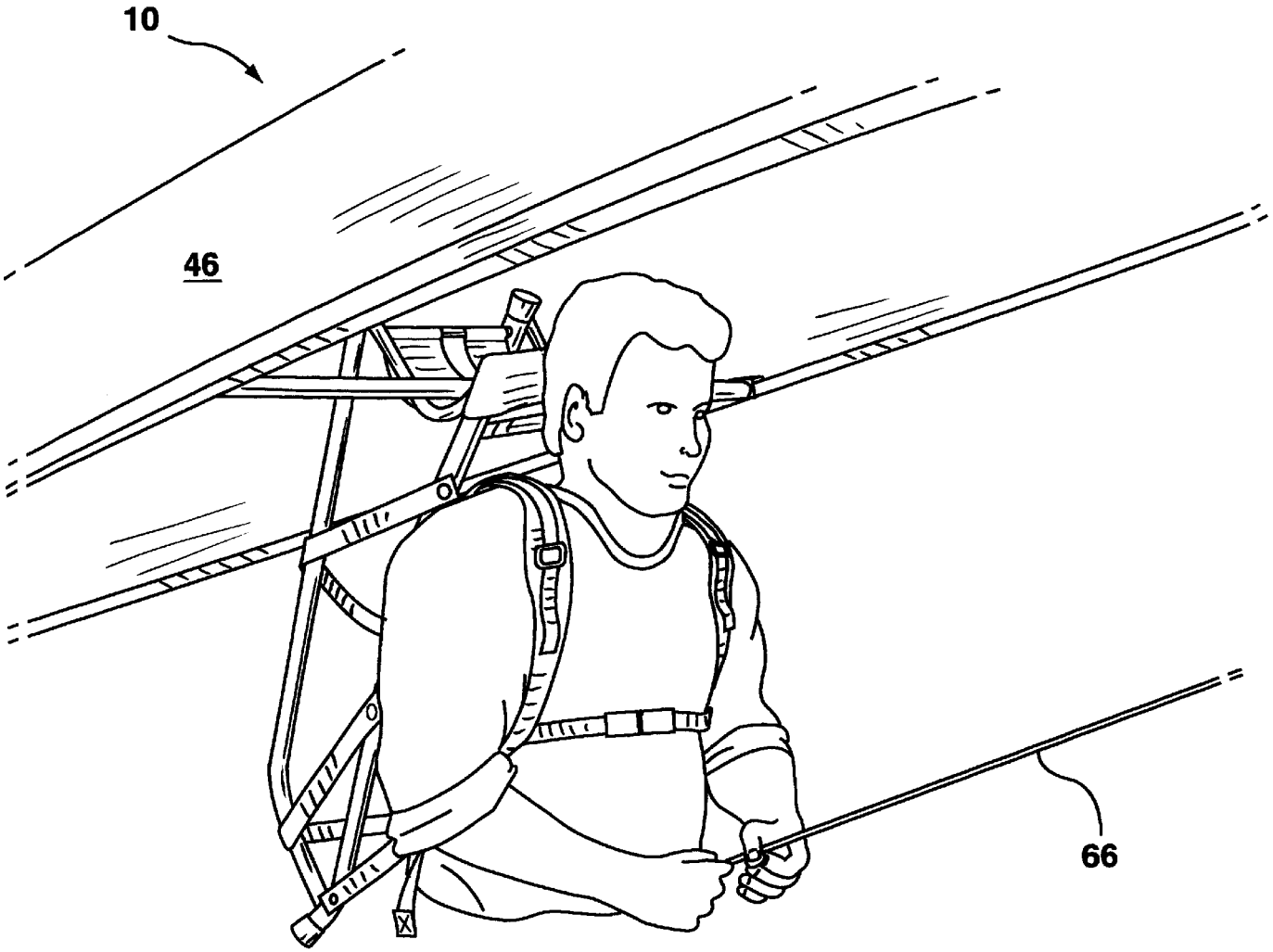
FIG. 10, in a front perspective view, illustrates a frame assembly as described in FIG. 10.
Figure 11:
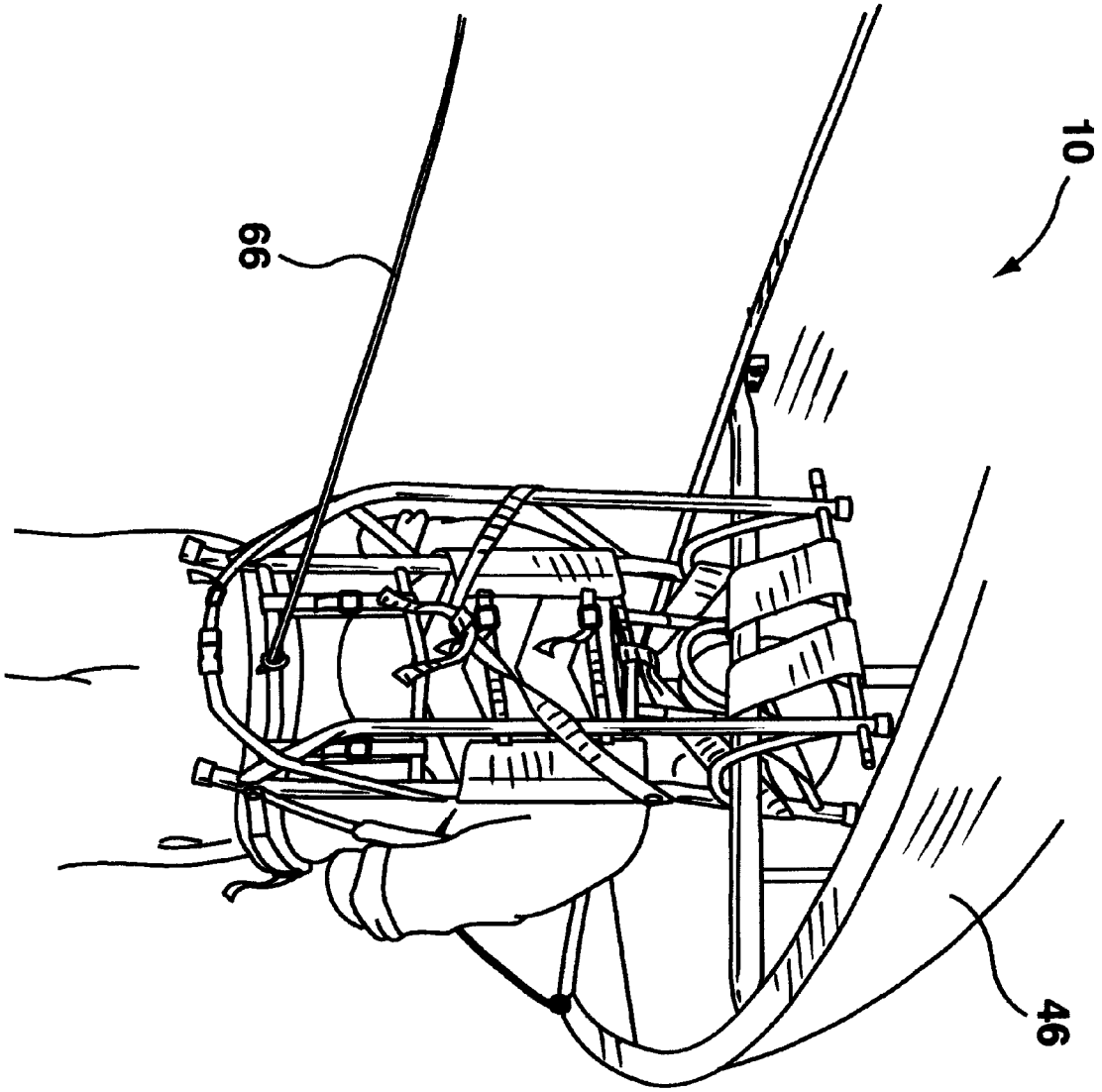
FIG. 11, in a back perspective view, illustrates a frame assembly as described in FIG. 10.
Figure 12:
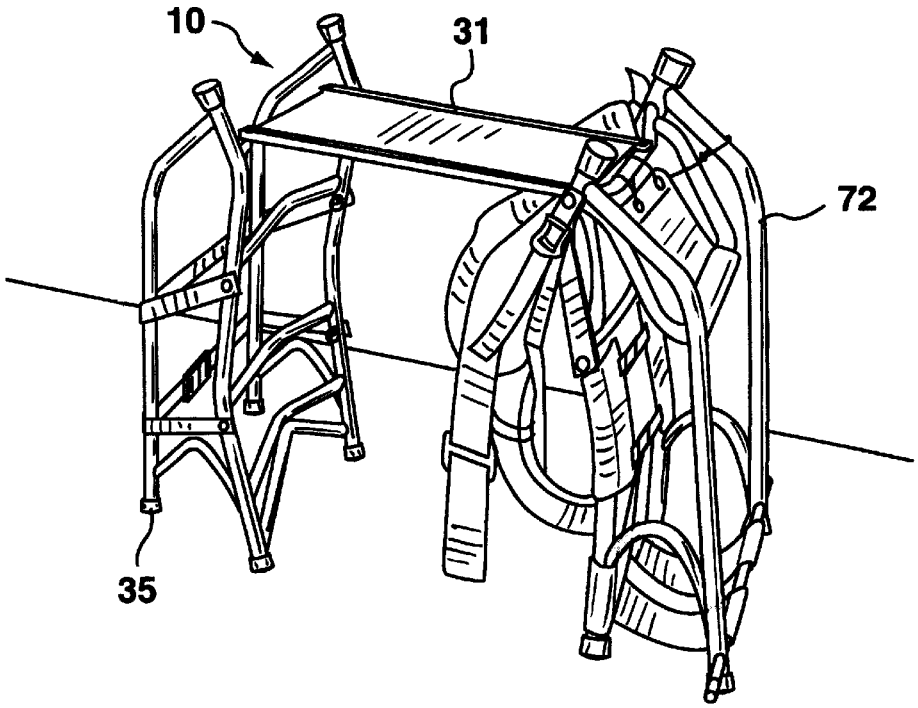
FIG. 12, in a top perspective view, illustrates the frame assemblies converted into a table.
Figure 13:
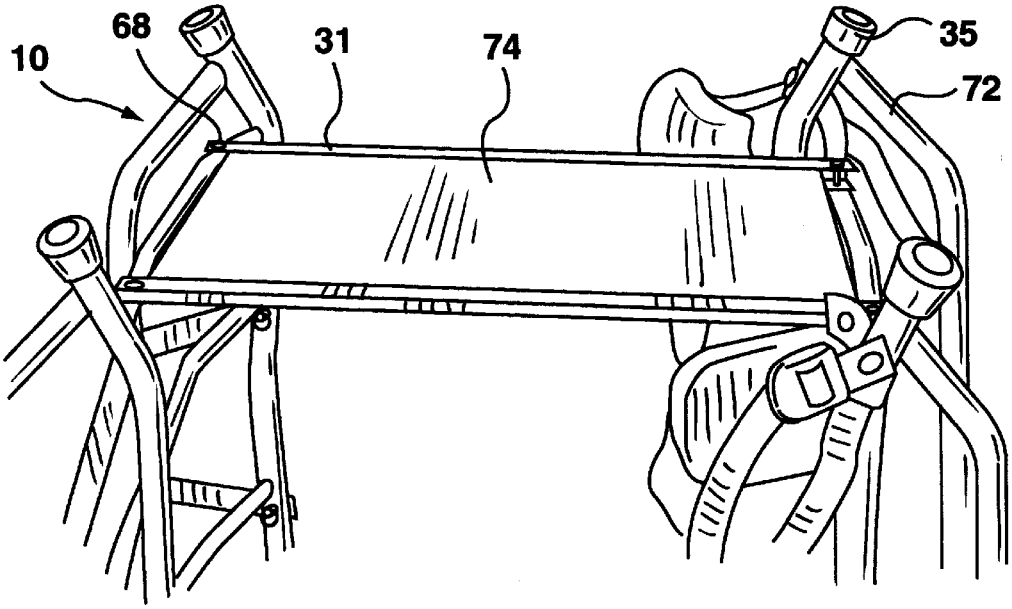
FIG. 13, in a top front view, illustrates the frame assemblies described in FIG. 12.
Figure 14:
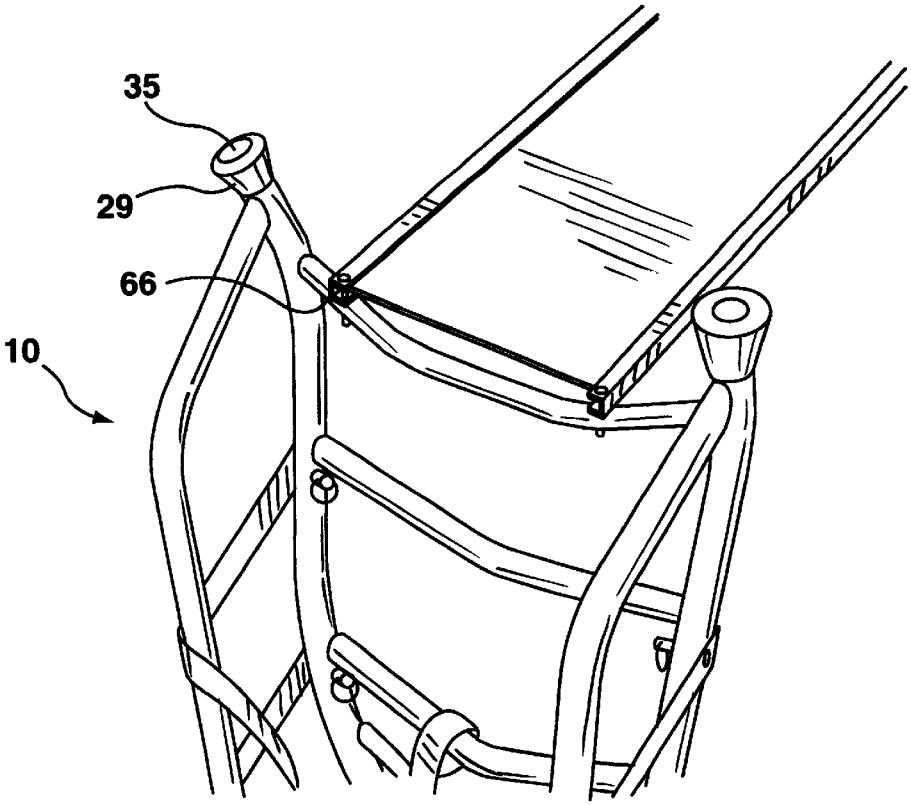
FIG. 14, in a side perspective view, illustrates the frame assemblies described in FIG. 12.
Figure 15:
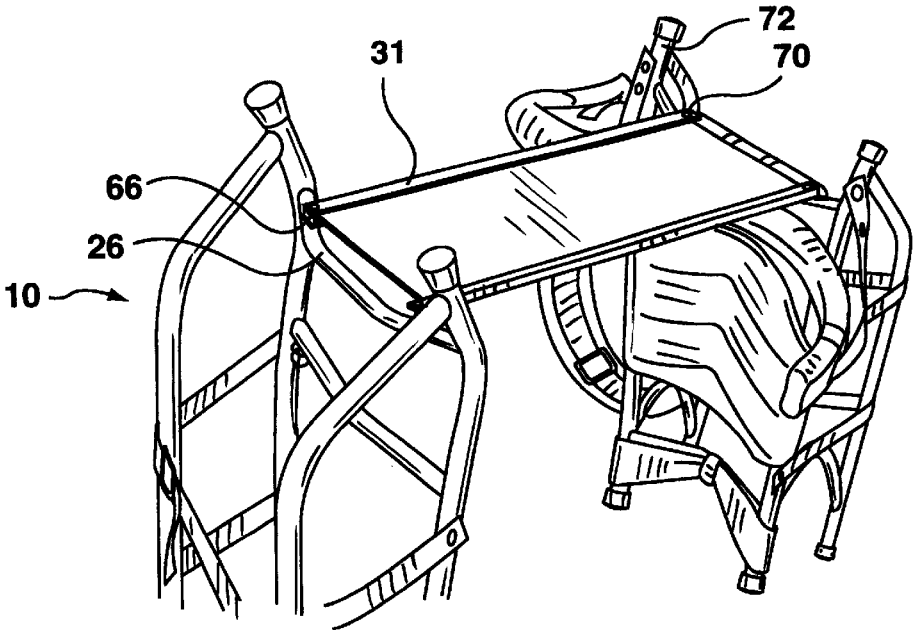
FIG. 15, in a side perspective view, illustrates the frame assemblies described in FIG. 12.
Figure 16:
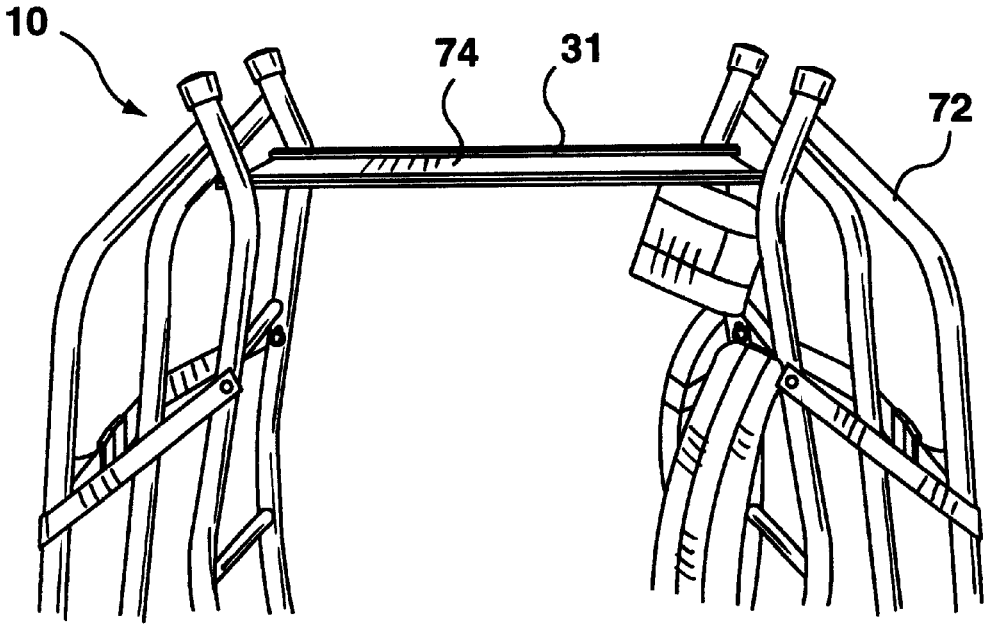
FIG. 16, in a front view, illustrates the frame assemblies described in FIG. 12.

The adjustable holding means 14 may be attached to the cross brace 30 of the second pair of rods 28, then oriented in such a way so as to rest against the support brace 27 of the first pair of rods 24. The adjustable holding means 14 may then be wrapped around the cross brace 26*e* and then looped back to attach at a point on cross brace 30. The adjustable holding means 14 may be further defined as an adjustable, flexible webbing 44 which allows the user to securely attach the canoe to the frame assembly 10 when in use. More specifically, when in use, the centre strut or yoke 46 of the canoe may rest against the adjustable flexible webbing 44 so as to balance the canoe above the user's head (see FIG. 10) while still allowing the user to traverse or portage over uneven terrain.

The adjustable carrying means 16 may be oriented to the first pair of rods 24 and cross braces 20 as described above. More specifically the adjustable carrying means 16 may further comprise of an adjustable back pad or cushion 48, a pair of adjustable shoulder straps 50, and an adjustable hip belt 52. The adjustable back pad 48 may be attached to the first pair of rods 24 and cross braces 20. The adjustable back pad 48 may be attached and adjusted to the user's preference by using a series of adjustable straps 54.

The pair of adjustable shoulder straps 50 may be mounted to the frame assembly 10 by attaching and securing a pair of lock pins 56 through a series of holes 57 in the cross braces 20 thereby connecting the cross braces 20. The pair of lock pins 56 therefore run parallel to the first pair of rods 24. The lock pins 56 may include a series of segregated cuffs 59 that slide over the lock pins 56. The adjustable shoulder straps 50 may be attached to the lock pins 56 through a rivet 60, thereby allowing the user to carry the frame assembly 10 on his/her back. More specifically, the rivet 60 of the adjustable shoulder straps 50 may sit in between two cuffs 59 thereby allowing the user to adjust the height of the adjustable shoulder straps 50.

The adjustable hip belt 52 may be attached to the frame assembly 10 through a series of adjustable straps 62, that allow the user to securely attach the frame assembly 10 to his/her waist/hips thereby providing additional support for carrying the canoe.

In operation, the user may lift the frame assembly 10 and slip the adjustable shoulder straps 50 over his/her shoulders and adjust and secure the straps 50 to the desired tension. The adjustable hip belt 52 may also be adjusted and secured to the user's preference. The user may then lift the canoe over his/her head and invert it so that the inside of the canoe is facing down over the user. The user may then rest the centre strut 46 of the canoe on the adjustable holding means 14 or webbing 44, where the canoe can then remain securely.

More specifically, the user can then proceed to portage or traverse difficult terrain without having to physically hold the canoe. Moreover, the canoe may be more securely balanced by attaching a lead 66 or rope between the front and back ends of the canoe, therefore allowing for the tipping of the canoe between the front and back. This is desirable when the user is moving uphill and requires greater visibility of the terrain ahead of him/her. The user would allow the canoe to tip upward by pulling on the lead and therefore bring the back end of the canoe down. The user can operate the frame assembly 10 for a canoe carrier backpack on his/her own without the aid of another individual and can therefore portage on their own.

The orientation of the frame assembly 10 also allows for the weight of the canoe to be easily distributed across the user's shoulders, back and down to their hips, therefore reducing the amount of strain and tension normally associated with carrying a canoe in traditional ways. By reducing the amount of tension and stress, the user can carry the canoe for longer periods of time, over longer distances without experiencing tension and muscle strain associated with traditional carriers.

The frame assembly 10 may also have additional adjustable straps 64 attached to the first pair of rods 24. The additional adjustable straps 64 allow the user to attach additional back-packing equipment, such as duffle bags, tenting equipment and the like to the frame assembly 10.

Referring to FIGS. 12–16, the frame assembly 10 may also be used as a support for a table 80 for use while camping. Specifically, the frame assembly 10 may be inverted so that the top end 29 of the frame assembly 10, and more specifically the protective caps 35 are resting on the ground. In one embodiment, the user may then remove the C-channel lengths 31 from the second pair of rods 28. A first end 66 of the C-channel length 31 may be attached to the frame assembly 10 at a hole on one of the cross braces 26. The C-channel length 31 may be secured to the frame assembly 10 using a lock and pin arrangement 68.

A second end 70 of the C-channel 31 may be connected using a lock and pin arrangement 68 to a second frame assembly 72 or other solid object. The C-channel lengths 31 may now be oriented perpendicular to the frame assembly 10 and the second frame assembly 72 or solid object allowing the user to place a table top 80 or other flat surface 74 on the C-channel lengths 31 resulting in a table-like platform that can be used for a table 80.

Various embodiments of the invention have now been described in detail. Since changes in and/or additions to the above-described best mode may be made without departing from the nature, spirit or scope of the invention, the invention is not to be limited to said details.

I claim:

1. A frame assembly for a canoe backpack carrier having a top end and a bottom end comprising:

(a) support means having a series of rods with a series of cross braces;

(b) adjustable holding means; and (c) adjustable carrying means;

wherein said adjustable carrying means and said adjustable holding means cooperate with said support means so that said adjustable holding means secures said canoe to said support means wherein, the arrangement of said rods and said cross braces form a first and second pair of rods wherein said pairs are connected to one another at said bottom end of said frame assembly.

2. A frame assembly for a canoe backpack carrier as claimed in claim 1 wherein, said adjustable carrying means attaches to said first pair of rods for orientation closest to said user's back.

3. A frame assembly for a canoe backpack carrier as claimed in claim 2 further comprising, a support brace attached to said first pair of rods at said top end of said frame assembly.

4. A frame assembly for a canoe backpack carrier as claimed in claim 3, wherein said second pair of rods are connected to one another by a cross brace located at said top end of said frame assembly.

5. A frame assembly for a canoe backpack carrier as claimed in claim 4, further comprising lengths of C-channel wherein said second pair of rods are hollow to accommodate said lengths of C-channel within each rod.

6. A frame assembly for a canoe backpack carrier as claimed in claim 5, wherein said second pair of rods are covered by protective caps to secure said lengths of C-channel within said second pair of rods.

7. A frame assembly for a canoe backpack carrier as claimed in claim 4, wherein said bottom end of said frame assembly has at least one foot for resting said frame assembly on when said frame assembly is not in use.

8. A frame assembly for a canoe backpack carrier as claimed in claim 4, wherein said first pair of rods and said second pair of rods are connected to one another by at least two curved cross braces at said top end of said frame assembly.

9. A frame assembly for a canoe backpack carrier as claimed in claim 8, wherein said adjustable holding means loops between said support brace of said first pair of rods and said cross brace of said second pair of rods.

10. A frame assembly for a canoe backpack carrier as claimed in claim 9, wherein said adjustable holding means is an adjustable flexible webbing.

11. A frame assembly for a canoe backpack carrier as claimed in claim 10, wherein said adjustable carrying means further comprises an adjustable pad or cushion, a pair of adjustable shoulder straps and an adjustable hip belt.

12. A frame assembly for a canoe backpack carrier as claimed in claim 11 wherein said adjustable shoulder straps are mounted to said frame assembly by at least two lock pins inserted through a series of holes in said cross braces of said first pair of rods thereby connecting said cross braces of said first pair of rods.

13. A frame assembly for a canoe backpack carrier as claimed in claim 12 wherein said lock pins further comprise a series of segregated cuffs that slide over said lock pins.

14. A frame assembly for a canoe backpack carrier as claimed in claim 13 wherein said adjustable shoulder straps further comprise at least two rivets wherein said adjustable shoulder straps are attached to said lock pins through said rivets wherein said rivets rest between said segregated cuffs.

15. A frame assembly for a canoe backpack carrier as claimed in claim 6 wherein said lengths of C-channels are removed from said second pair of rods and a first end of said lengths of C-channels are attached to said frame assembly at a hole on said cross brace of said first pair of rods and a second end of said lengths of C-channels are attached to a solid object.

16. A frame assembly for a canoe backpack carrier as claimed in claim 15 wherein said first ends of said lengths of C-channels are attached to said frame assembly by a lock and pin arrangement.

17. A frame assembly for a canoe backpack carrier as claimed in claim 16 further comprising a table top or other flat surface wherein said table top or other flat surface rests on top of said lengths of C-channel attached to said frame assembly at said first ends and to said solid object at said a second ends.

* * * * *